United States Patent [19]

MacLaren

[11] 4,404,441

[45] Sep. 13, 1983

[54] SWITCHING DEVICE WITH SEPARATE SWITCHING AND ACTUATOR RODS

[76] Inventor: David S. MacLaren, West Hill Dr., Gates Mills, Ohio 44040

[21] Appl. No.: 387,791

[22] Filed: Jun. 14, 1982

Related U.S. Application Data

[63] Continuation of Ser. No. 185,321, Sep. 9, 1980, abandoned.

[51] Int. Cl.[3] ..... H01H 35/18

[52] U.S. Cl. ..... 200/84 C; 340/624

[58] Field of Search ..... 340/623, 624; 200/61.2, 200/81 R, 153 V, 81.5, 85 R, 84 R, 84 C; 335/205; 73/308, 309, 311, 313, 319

[56] References Cited

U.S. PATENT DOCUMENTS 1,557,654 10/1925 Caspain ..... 73/311

2,736,013 2/1956 Binford ..... 200/84 C

FOREIGN PATENT DOCUMENTS 2047468 11/1980 United Kingdom ..... 200/84 C

*Primary Examiner*—G. P. Tolin

*Attorney, Agent, or Firm*—Woodling, Krost & Rust

[57] ABSTRACT

A fluid level sensitive switching device is disclosed that utilizes a lost motion type action to increase the available fluid drawdown and cycle level of the switching device.

15 Claims, 14 Drawing Figures

SWITCHING DEVICE WITH SEPARATE SWITCHING AND ACTUATOR RODS

This is a continuation of application Ser. No. 185,321, filed Sept. 9, 1980, and now abandoned.

This invention relates to a fluid level sensitive float operated switching device.

In the invention a float cooperates with a lost-motion type interconnection to predictably operate a switch over a large range of fluid levels.

The present invention combines a high allowance of fluid with the availability of under the high fluid level switching mechanism mounting.

The present invention provides for a large range of accommodated fluid levels. A single embodiment of a switching mechanism built according to the teachings of the present invention can be adjusted for use in a wide range of circumstances.

The present invention provides for an accurate repeatability of cycle levels; the activation of the switching mechanism is predictable.

The present invention provides for a flexible under the high fluid level switching mechanism.

Other objects and a fuller understanding of the invention may be had by referring to the following description and claims taken in conjunction with the accompanying drawings in which:

This invention relates to a fluid level sensitive float operated switching device. A lost-motion type connection increases the available fluid drawn down and lengthens the cycle time of fluid operated switching devices.

Figure 1:
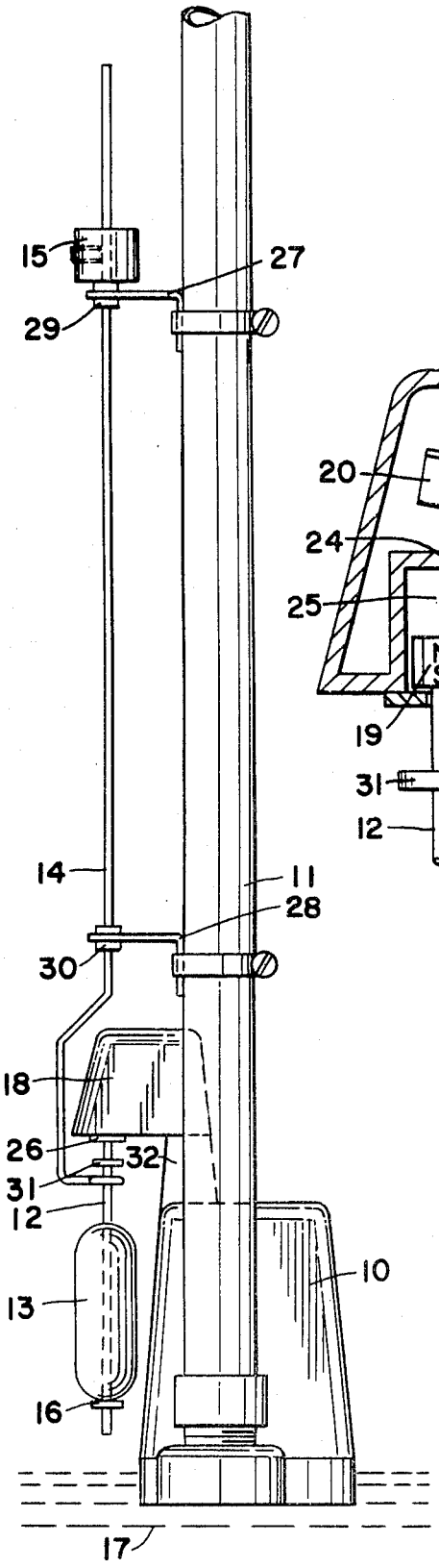
FIG. 1 is a side view of a float-down embodiment of the invention in combination with a submersible sump pump.

The first disclosed preferred embodiment of this invention has a float lowermost (FIGS. 1 and 5).

The first embodiment (FIG. 1) is shown in combination with a sump pump 10 and a discharge tube 11. The sump pump 10 and discharge tube 11 are of a conventional construction. They are, however, able to be sized differently for a given function than regularly switched pumps; it is an advantage of this invention that cycle times and fluid draw down for a single switching operation are increased.

This first embodiment includes in combination a switching rod 12, a float 13, an actuator rod 14 and a compensating part 15.

The float 13 is slidingly connected to the switching rod 12. A float stopper 16 prevents the float 13 from sliding off of the switching rod. The float 13 has a positive buoyancy when under fluid sufficient to support itself, the switching rod 12, the actuator rod 14 and the compensating part 15 when the compensating part 15 is substantially more than half way in fluid but not sufficient to support itself, the switching rod 12, the actuator rod 14 and the compensating part 15 when the compensating part is substantially more than half way out of fluid.

The top of the switching rod 12 extends within a switching box 18. The switching box 18 is mounted to the sump pump 10 by a mounting piece 32. The switching box 18 contains a switch and a device able to support the switching rod 12 but not the switching rod 12 and the float 13 when the float is substantially more than half way out of fluid. The device of FIG. 2 is a typical structure capable of preforming these functions.

The distance of half way point of the float 3 from the bottom 17 of the sump substantially determines the low fluid level of the embodiment.

Figure 2:
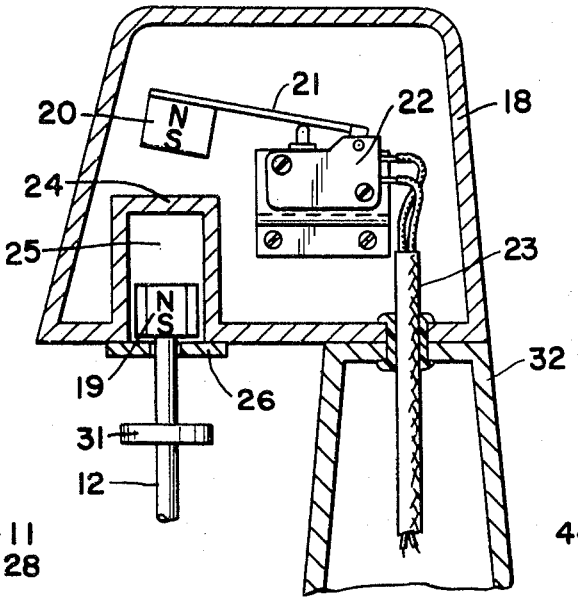
FIG. 2 is an enlarged cutaway side view of the encapsulated switch in FIG. 1.

In FIG. 2 a magnet 19 is attached to the top of the switching rod 12. A magnet 20 of attracting pole is attached to a lever arm 21 of a micro-switch 22. Wires 23 lead from the micro-switch 22 to the switched object, in this case pump 10.

The magnetic attraction between magnet 19 and magnet 20 is sufficient such that when magnet 19 is substantially at the end portion 24 of the magnet recess 25 magnet 20 is attracted to more to the end portion 24 of the magnet recess 25 to operate the micro-switch 22 and that when magnet 19 and magnet 20 are so positioned on opposite sides of the end portion 24 of the magnet recess 25 their magnetic attraction can support the switching rod 12 but not the switching rod 12 and the float 13 when the float is substantially more than half way out of the fluid to be pumped.

Other structures capable of performing these functions include replacing one of the magnets with a ferrous piece, replacing both magnets with a spring presenting an equivalent upward pressure, the Meyers Pump, Hydromatic mercury displacement switch or other similar structures known in the art.

In the structure of FIG. 2 the magnet 19 in combination with a plate 26, which is integrally connected to box 18, serves to suspend the switching rod 12 in an upright position.

The compensating part 15 is fixedly attached to the actuator rod. In the embodiment of FIGS. 1 and 5, the compensating part 15 is a displacement weight. The displacement weight compensating part 15 has a specific gravity such that it has a positive weight when substantially out of fluid and substantially no weight or buoyancy when substantially in fluid. The distance of the halfway point of the displacement weight compensating part 15 from the bottom 17 of the sump substantially determines the high fluid level of the embodiment. The actuator rod 14 is spaced from the discharge tube 11 by stand-offs 27 and 28. Bushings 29 and 30 on the stand-offs 27 and 28 respectively allow for free up-down movement of the actuator rod 14.

The bottom of the actuator 14 is slidingly connected to the switching rod 12 above the float 13 but below an actuating snubber 31.

FIG. 5 is a sequence of drawings detailing the mode of operation of this first embodiment. For this series of drawings the interior switching box 18 of FIG. 2 is shown in simplified form.

In drawing 5A the embodiment is as it would be at a low fluid level. This is also the status of this embodiment in FIG. 1. The switching rod 12 is in its lowest position. The float 13 is resting against the float stopper 16. The actuator rod 14 is in its lowest position. The compensating part 15 is resting against the bushing 29 of a stand-off 27. The switch is off.

When the fluid level rises above the float 3, drawing 5B, the float 13 rises to bear against the lower end of the actuator rod 14. However, because the float cannot raise the switching rod 12, actuator rod 14 and displacement weight compensating part 15 when the displacement weight compensating part 15 is more than half way out of fluid and the displacement weight compensating part 15 is still out of fluid, the float 13 can rise no further. The switch remains off.

When the fluid level rises above the half way point of the displacement weight compensating part 15 the float 13, being able to raise the switching rod 12, actuator rod 14 and displacement weight compensating part 15 when the displacement weight compensating part 15 is half way in fluid, is able to rise further, drawing 5C. The float 13 rises to push the lower end of the actuator rod 14 against the actuating snubber 31. The float 13 continues to rise lifting the switching rod 12 from its lowest position. Magnet 20 is attracted to magnet 19 and the switch turns on.

In drawing 5D the fluid level has dropped below the displacement weight compensating part 15. The displacement weight compensating part 15 has returned to rest against the bushing 29 of a stand-off 27. The actuator rod 14 has returned to its lowest position. The lower end of the actuator rod 14 has pushed the float 13 downward. The float 13 itself retains a positive buoyancy. The switching rod 12, however, is held up by the attraction of magnet 19 to magnet 20 and is unaffected. The switch remains on.

In the final drawing 5E the fluid level has dropped to a low level. The float 13 is more than half way out of fluid. This causes the float 13 to have a positive weight. The float 13 bears on the float stopper 16 to pull the switching rod 12 downward. This breaks the attraction of magnet 19 to magnet 20. The switch turns off. The cycle then can begin anew.

Figure 3:
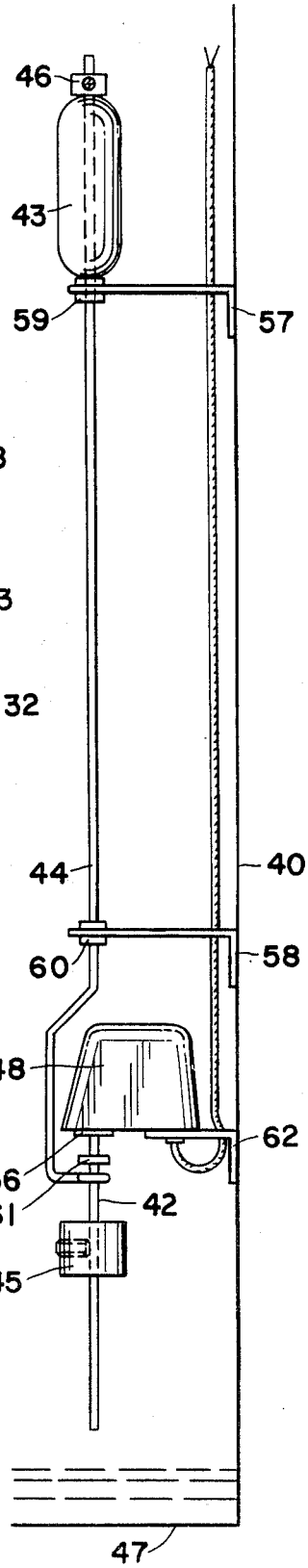
FIG. 3 is a side view of a compensating part-down embodiment of the invention as mounted on a wall.

The second disclosed preferred embodiment of this invention has a compensating part lowermost (FIGS. 3 and 6).

This second embodiment (FIG. 3) is shown as a remote switching mechanism in combination with a wall 40.

This second embodiment includes in combination a switching rod 42, a compensating part 45, an actuator rod 44 and a float 43.

The compensating part 45 is fixedly attached to the switching rod 42. In the embodiment of FIGS. 3 and 6 the compensating part 45 is a displacement weight. The displacement weight compensating part 45 has a specific gravity such that it has a positive weight when substantially out of fluid and substantially no weight or buoyancy when substantially in fluid. The distance of the half way point of the displacement weight compensating point 45 from the bottom 47 of the sump determines the low fluid level of the embodiment.

The top of the switching rod 42 extends within a switching box 48. The switching box 48 is mounted to the wall 40 by mounting bracket 62. The switching box 48 contains a switch and a device able to support the switching rod 42 and the displacement weight compensating part 45 when the displacement weight compensating part 45 is more than half way in fluid but not the switching rod 42 and the displacement weight compensating part 45 when the displacement weight compensating part 45 is more than half way out of fluid. A typical structure would be the same as that disclosed in FIG. 2. The magnetic attraction between magnet 19 (49) and 20 (50) when on opposite sides of the end portion 24 of the magnet recess 25 can support the switching rod 42 and displacement weight compensating part 45 when the displacement weight compensating part 45 is substantially more than half way in fluid but not the switching rod 42 and displacement weight compensating part 45 when the displacement weight compensating part 45 is substantially more than half way out of fluid.

The float 43 is connected to the actuator rod 44 by a float stopper. The float 43 has a positive buoyancy when substantially half way in fluid sufficient to support itself, the actuator rod 44, the switching rod 42 and the displacement weight compensating part 45. The distance of the half way point of the float 43 from the bottom 47 of the sump determines the high fluid level of the embodiment. The actuator rod 44 is spaced from the wall by stand-offs 57 and 58. Bushings 59 and 60 on the stand-offs 57 and 58 respectively allow for free up-down movement of the actuator rod 44.

The bottom of the actuator rod 44 is slidingly connected to the switching rod 42 above the displacement weight compensating part 45 but below an actuating snubber 61.

FIG. 6 is a sequence of drawings detailing the mode of operation of this second embodiment. The interior of the switching box 48 is shown in a simplified form.

In drawing 6A the embodiment is as it would be at low fluid level. This is also the status of this embodiment in FIG. 3. The switching rod 42 is in its lowest position. The displacement weight compensating part 45 being partially out of fluid has a positive weight. The actuator rod 44 is in its lowest position. The float 43 is resting against the bushing 59 of a stand-off 57. The switch is off.

When the fluid level rises above the displacement weight compensating part 45, drawing 6B, the displacement weight compensating part 45 obtains a substantially neutral weight. The switching rod 42 and actuator rod 44 remain in their lowest positions; there is yet no force present in the embodiment to move them upward. The switch remains off.

When the fluid level rises half way up the float 43, the float 43, when substantially half way in fluid, being able to raise the actuator rod 44, the switching rod 42 and the displacement weight compensating part 45 when the displacement weight compensating part 45 is in fluid, rises against float stopper 46 to pull the lower end of the actuator rod 44 against the actuating snubber 61. The float 43 continues to rise lifting the switching rod 42 from its lowest position. Magnet 50 is attracted to magnet 49 and the switch turns on.

In drawing 6D the fluid level has dropped below the float 43. The float 43 has returned to rest against the bushing 59 of a stand-off 57. The actuator rod 44 has returned to its lowest position. The lower end of the actuator rod 44 has ceased to bear against the actuating snubber 61. The switching rod 42 and displacement weight compensating part 45, however, are held up by the attraction of magnet 50 to magnet 49, that attraction being able to support the switching rod 42 and the displacement weight compensating part 45 when the displacement weight compensating part 45 is more than half way in fluid. The switch remains on.

In the final drawing 6E the fluid level has dropped to a low level. The displacement weight compensating part 45 is more than half way out of fluid. This causes the displacement weight compensating part 45 to have a positive weight sufficient to pull the switching rod 42 downward. The attraction of magnet 49 to magnet 50 is broken and the switch turns off. The cycle then can begin anew.

Figure 4:
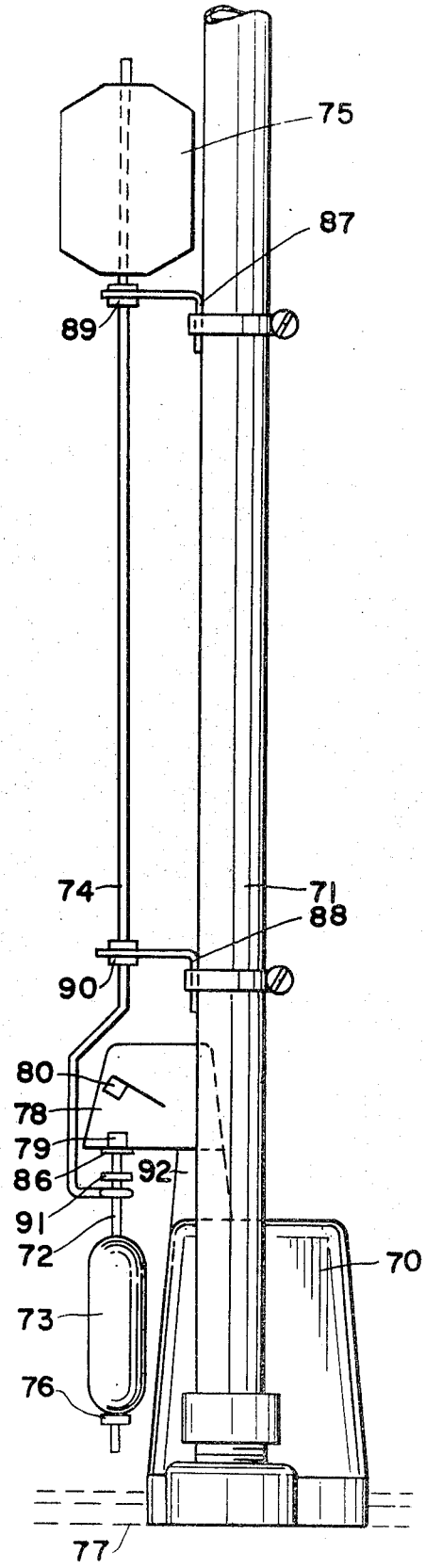
FIG. 4 is a side view of a twin float embodiment of the invention.
Figure 5E:
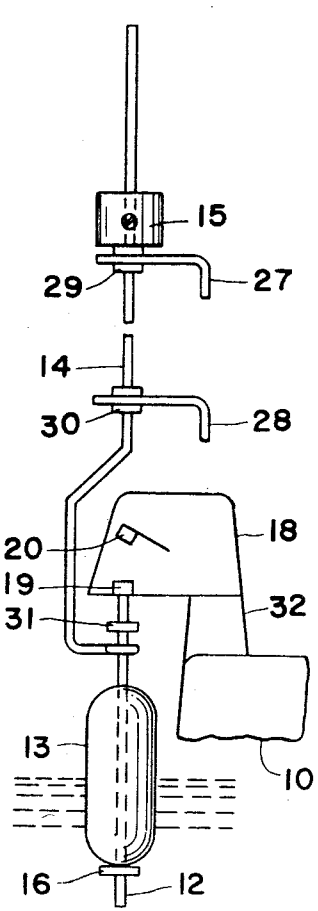
FIG. 5 is a sequence of drawings detailing the mode of operation of the float-down embodiment of FIG. 1.
Figure 5D:
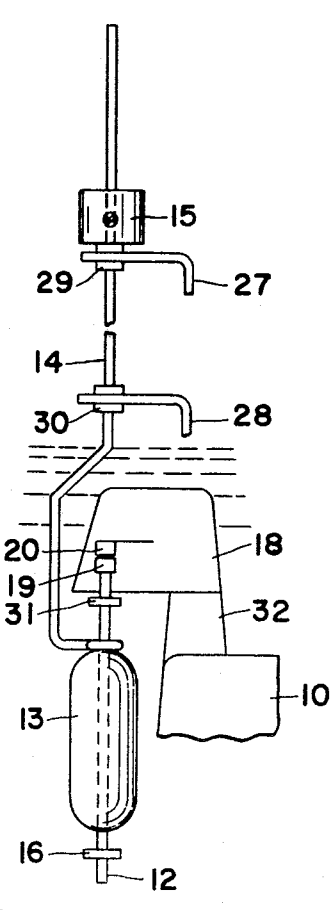
Figure 5C:
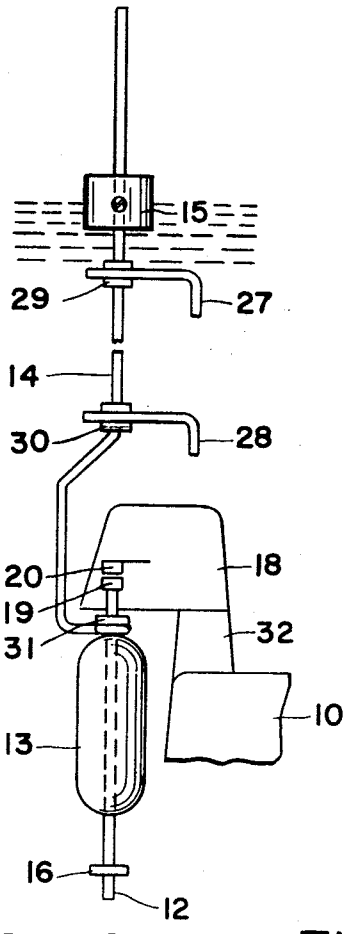
Figure 5B:
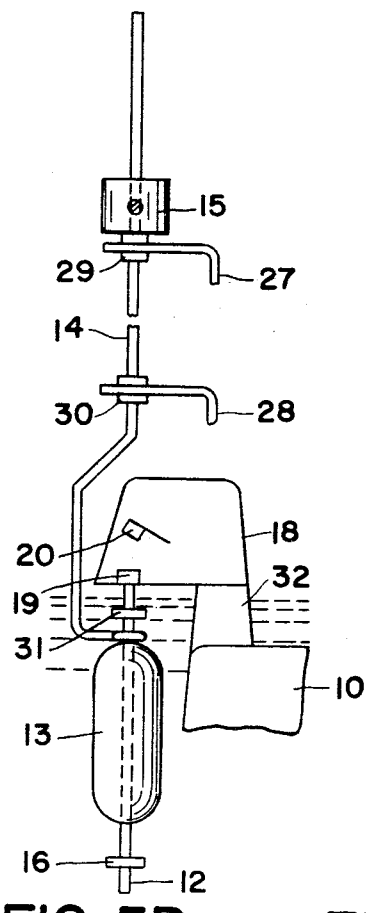
Figure 5A:
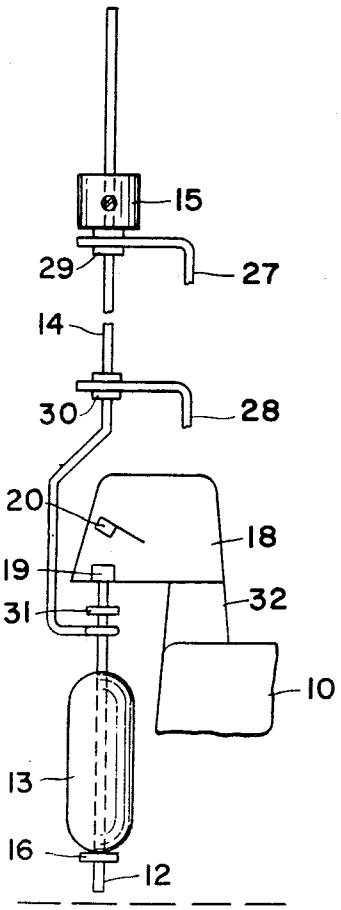
Figure 6E:
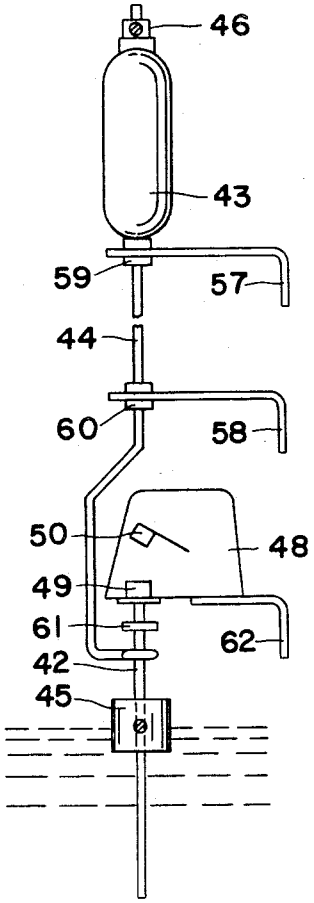
FIG. 6 is a sequence of drawings detailing the mode of operation of the compensating part-down embodiment of FIG. 3.
Figure 6D:
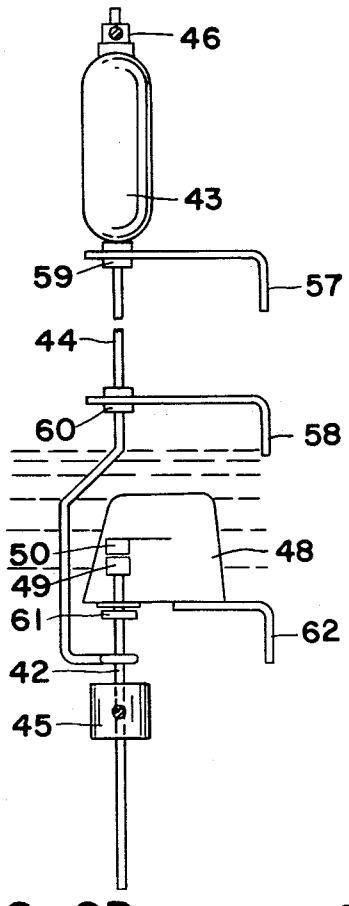
Figure 6C:
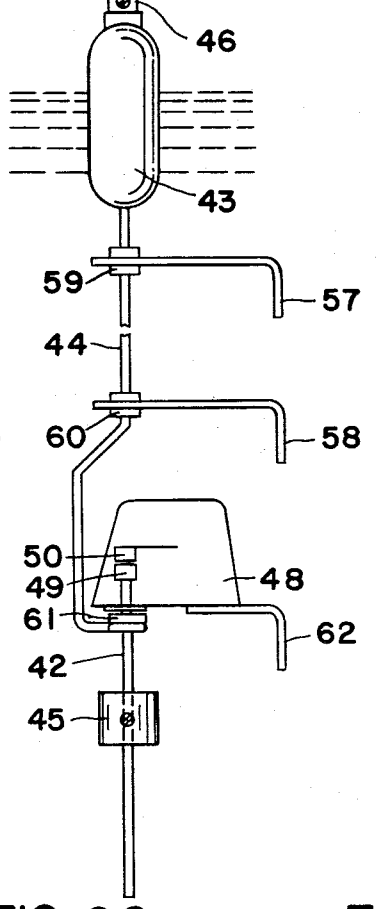
Figure 6B:
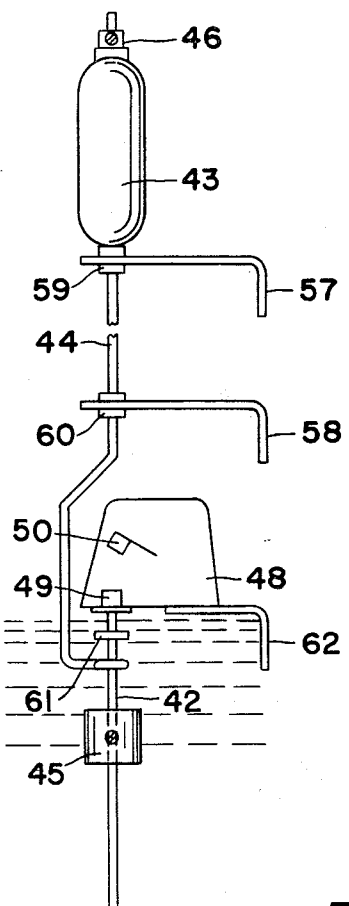
Figure 6A:
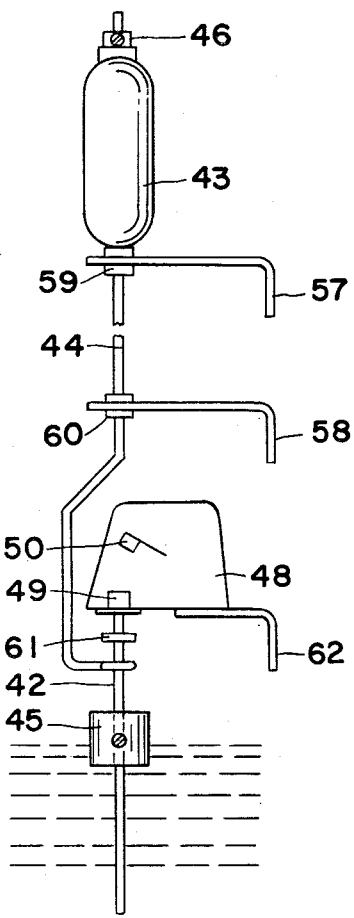

The embodiments of FIGS. 1 and 3 incorporate a displacement weight compensating part 15 and 45 respectively in combination with a float 13 and 43 respectively. The compensating part 15 and 45 could equally well have been floats having certain attributes similar to those recited. FIG. 4 is a twin float embodiment.

This third embodiment includes in combination a switching rod 72, a float 73, an actuating rod 74 and a compensating part 75.

The float 73 is slidingly connected to the switching rod 72. A float stopper 76 holds the float on the switching rod 72.

The top of the switching rod 72 extends within a switching box 78. The switching box 78 is mounted to the sump pump 70 by a mounting piece 92. The switching box 78 contains a switch and a device able to support the switching rod 72 and the float 73 when the float 73 is substantially in fluid but not the switching rod 72 and the float 73 when the float 73 is substantially not in fluid. A typical structure would be the same as disclosed in FIG. 2. The magnetic attraction between magnet 19 (79) and 20 (80) when on opposite sides of the end portion 24 of the magnet recess 25 can support the switching rod 72 and float 73 when the float is substantially in fluid but not the switching rod 72 and the float 73 when the float is substantially not in fluid.

A float compensating part 75 is fixedly attached to the actuator rod 74.

The buoyancy of float 73 and the float compensating part 75 are inter-related.

Together the buoyancy of float 73 and the float compensating part 75 can at least raise the float 73, the switching rod 72, the actuator rod 73 and the float compensating part 75. If both the float 73 and float compensating part 75 are in fluid these elements rise.

In addition, the buoyancy of the float 73 is limited in that its buoyancy alone cannot raise the float 73, the switching rod 72, the actuator rod 74 and the float compensating part 75 when the float compensating part 75 is out of fluid.

The buoyancy of the float compensating part 75 is not so limited. It may be extremely buoyant.

The confines of this third embodiment are very flexible. A device built according to the teachings of this third embodiment could have a small relatively non-buoyant float compensating part 75 in combination with a relatively buoyant float 73. This device would be very similar to the first embodiment of this disclosure (see FIG. 1). A device built according to the teachings of this third embodiment could equally well have a relatively buoyant float compensating part 75 in combination with a relatively non-buoyant float 73. This second device would be very similar to the second embodiment of this disclosure (see FIG. 3).

Although the invention of this application has been described in its two preferred forms with a certain degree of particularity it is to be understood that numerous changes could be made without departing from the scope of the invention.

What is claimed is:

1. A switching mechanism for a fluid pump comprising a switching rod having upper and lower end portions, said switching rod being movable between first and second vertical positions, a float stopper affixed to said lower end portion of said switching rod, a float slidingly connected to said switching rod above said float stopper, said float having a positive buoyancy when substantially in the fluid to be pumped and a weight when substantially out of the fluid to be pumped, an actuating snubber affixed to said upper end portion of said switching rod above said float, switching means for said switching rod to switch electricity, said switching means actuating in said first vertical position of said switching rod, magnetic means supporting said switching rod in said first vertical position when said float is substantially in the fluid to be pumped but not sufficient for supporting said switching rod when said float is substantially out of the fluid to be pumped, an actuator rod having upper and lower end portions, support means to slidingly support said actuator rod for movement between first and second vertical positions, a compensating part affixed to said upper end portion of said actuator rod, said positive buoyancy of said float being sufficient to float said switching rod, said actuator rod and said compensating part when said compensating part is substantially in the fluid to be pumped but not sufficient to float said switching rod, said actuator rod and said compensating part when said compensating part is substantially out of the fluid to be pumped, said lower end portion of said actuator rod being slidingly connected to said switching rod between said float and said actuating snubber, the entrance of said float in the fluid to be pumped causing said float to rise and engage said lower end portion of said actuator rod with insufficient force to move said actuator rod to said first vertical position and the entrance of said compensating part in fluid enabling said float to move said actuator rod and switching rod to said first vertical positions to actuate said switching means for said switching rod to switch electricity, removal of the fluid from said compensating part moving said lower end portion of said actuator rod and said float away from said actuating snubber and removal of the fluid from said float causing said float to bear on said float stopper creating a weight greater than the supporting abilities of said magnetic means supporting said switching rod in said first vertical position which causes said switching rod to move vertically to said second position to deactuate said switching means for said switching rod to switch electricity.

2. A switching mechanism for a fluid pump comprising a switching rod having upper and lower end portions and being positioned in a substantially vertical position, said switching rod being movable between first and second vertical positions, a float stopper affixed said lower end portion of said switching rod, a float slidingly connected to said switching rod above said float stopper, said float having a positive buoyancy when substantially in the fluid to be pumped and a weight when substantially out of the fluid to be pumped, an actuating snubber affixed to said upper end portion of said switching rod above said float, magnetically actuated switching means, magnetic means carried by said upper end portion of said switching rod and in said first vertical position thereof actuating said magnetically actuated switching means, said magnetic means and said magnetically actuated switching means having a magnetic attracting sufficient to support said switching rod in said first vertical position when said float is substantially in the fluid to be pumped but not sufficient to support said switching rod when said float is substantially out of the fluid to be pumped, an actuator rod having upper and lower end portions and being positioned in a substantially vertical position, support means to slidingly support said actuator rod for movement between first and second vertical positions, a compensating part affixed to said upper end portion of said actuator rod, said positive buoyancy of said float being sufficient to float said switching rod, said actuator rod and said compensating part when said compensating part is substantially in the fluid to be pumped but not sufficient to float said switching rod, said actuator rod and said compensating part when said compensating part is substantially out of the fluid to be pumped, said lower end portion of said actuator rod being slidingly connected to said switching rod between said float and said actuating snubber, the entrance of said float in the fluid to be pumped causing said float to rise and engage said lower end portion of said actuator rod with insufficient force to move said actuator rod to said first vertical position and the entrance of said compensating part in fluid enabling said float to move said actuator rod and switching rod to said first vertical positions to actuate said magnetically actuated switching means, removal of the fluid from said compensating part moving said lower end portion of said actuator rod and said float away from said actuating snubber and removal of the fluid from said float causing said float to bear on said float stopper creating a weight greater than said magnetic attraction which causes said switching rod to move vertically to said second position to deactuate said magnetically actuated switching means.

3. A switching mechanism for a fluid pump comprising a switching member, said switching member being movable upward and downward, a compensating part fixedly connected to the switching member, said compensating part having a weight when substantially out of the fluid to be pumped, an actuating snubber affixed to the switching member, switching means for said switching member to switch electricity, said switching means actuating in said upper position of said switching member, magnetic means, said magnetic means having a magnetic attraction with said switching member, said magnetic attraction sufficient for retaining said switching member in said upward position when said compensating part is substantially in the fluid to be pumped but not sufficient for retaining said switching member in said upward position when said compensating part is substantially out of the fluid to be pumped, an actuator member, said actuator member having first and second ends, a float connected to said first end of said actuator member, said float having a positive buoyancy when substantially in the fluid to be pumped and a weight when substantially out of the fluid to be pumped, said positive buoyancy of said float being sufficient to raise said switching member, said actuator member and said compensating part when said compensating part is substantially in the fluid to be pumped, said second end of said actuator member being connected to said switching member in a lost-motion type interconnection, the entrance of said float in the fluid to be pumped causing said float to move said actuator member and move said switching member and compensating part to said upward position to actuate said switching means for said switching member to switch electricity and to engage said magnetic attraction between said magnetic means and said switching member, removal of the fluid from said float moving said actuator member down and removal of the fluid from said compensating part creating a weight greater than said magnetic attraction between said magnetic means and said switching member can retain in said upward position which causes said switching member to move to said downward position to deactuate said switching means for said switching member to switch electricity.

4. A switching mechanism for a fluid pump comprising a switching rod having upper and lower end portions, said switching rod being movable between first and second vertical positions, a compensating part fixedly connected to said lower end portion of said switching rod, said compensating part having a weight when substantially out of the fluid to be pumped, an actuating snubber affixed to said upper end portion of said switching rod, switching means for said switching rod to switch electricity, said switching means actuating in said first vertical position, magnetic means, said magnetic means having a magnetic attraction with said switching rod, said magnetic attraction sufficient for retaining said switching rod in said first vertical position when said compensating part is substantially in the fluid to be pumped but not sufficient for retaining said switching rod in said first vertical position when said compensating part is substantially out of the fluid to be pumped, an actuator rod having upper and lower end portions, support means to slidingly support said actuator rod for movement between first and second vertical positions, a float affixed to said upper end portion of said actuator rod, said float having a positive buoyancy when substantially in the fluid to be pumped and a weight when substantially out of the fluid to be pumped, said positive buoyancy of said float being sufficient to float said switching rod, said actuator rod and said compensating part when said compensating part is substantially in the fliud to be pumped, said lower end portion of said actuator rod being slidingly connected to said switching rod between said compensating part and said actuating snubber, the entrance of said float in the fluid to be pumped causing said float to move said lower end portion of said actuator rod to bear on said actuating snubber and move said switching rod and said compensating part to said first vertical position to actuate said switching means for said switching rod to switch electricity, and to engage said magnetic attraction between said magnetic means and said switching member, removal of the fluid from said float to move said lower end portion of said actuator rod away from bearing on said actuating snubber and removal of the fluid from said compensating part creating a weight greater than said magnetic attraction between said magnetic means and said switching rod can retain which causes said switching rod to move vertically to said second position to deactuate said switching means for said switching rod to switch electricity.

5. A switching mechanism for a fluid pump comprising a switching rod having upper and lower end portions and being positioned in a substantially vertical position, said switching rod being movable between first and second vertical positions, a compensating part fixedly connected to said lower end portion of said switching rod, said compensating part having a weight when substantially out of the fluid to be pumped, an actuating snubber affixed to said upper end portion of said switching rod, magnetically actuated switching means, magnetic means carried by said upper end portion of said switching rod and in said first vertical position thereof actuating said magnetically actuated switching means, said magnetic means and said magnetically actuated switching means having a magnetic attraction sufficient to support said switching rod in said first vertical position when said compensating part is substantially in the fluid to be pumped but not sufficient to support said switching rod in said first vertical position when said compensating part is substantially out of the fluid to be pumped, an actuator rod having upper and lower end portions and being positioned in a substantially vertical position support, support means to slidingly support said actuator rod for movement between first and second vertical positions, a float affixed to said upper end portion of said actuator rod, said float having a positive buoyancy when substantially in the fluid to be pumped and a weight when substantially out of the fluid to be pumped, said positive buoyancy of said float being sufficient to raise said switching rod, said actuator rod and said compensating part when said compensating part is substantially in the fluid to be pumped, said lower end portion of said actuator rod being slidingly connected to said switching rod between said compensating part and said actuating snubber, submerging of said float in the fluid to be pumped causing said float to move said lower end portion of said actuator rod to bear on said actuating snubber and move said switching rod and said compensating part to said first vertical position to actuate said magnetically actuated switching means, removal of the fluid from said float moving said lower end portion of said actuator rod away from bearing on said actuating snubber and removal of the fluid from said compensating part creating a weight greater than the supporting attraction of said magnetic means which causes said switching rod to move vertically to said second position to deactuate said magnetically actuated switching means.

6. In a fluid level actuated device having a substantially vertical rod with two associated displacement parts, the first connected to the rod and the second slidingly connected through a lost-motion type interconnection to the rod, an improvement comprising the addition of a separate actuator member between the second displacement part and the rod, said actuator member being connected through a lost-motion type interconnection to the rod and the second displacement part being connected to said rod, switching means for the rod to switch electricity and retention means to hold the rod in position to actuate said means for the rod to switch electricity until the fluid level has fallen substantially below the lower of the displacement parts, such that when both displacement parts are substantially in fluid the rod actuates said switching means and when the lower of the displacement parts is substantially out of fluid the rod fails to deactuate said switching means.

7. The fluid level actuated device of claim 6 characterized by the addition of a magnet means and in that said switching means and said retention means are both the result of the same magnetic attraction of said magnet means.

8. In a fluid level actuated device having a substantially vertical rod movable from upper to lower positions and having two associated displacement parts, the first fixedly connected to the rod and the second slidingly connected through a lost-motion type interconnection to the rod, the second displacement part having a separate solid support to limit its downward travel, an improved switching device comprising a separate actuator rod 14,44,74, said actuator rod 14,44,74 being slidingly supported in a substantially vertical position, said actuator rod forming the lost-motion type interconnection between the second displacement part 15,43,75 and the rod 12,42,72, said actuator rod 14,44,74 having upper and lower portions, said second displacement part 15,43,75 being connected to said upper portion of said actuator rod 14,44,74 and said lower portion of said actuator rod 14,44,74 being interconnected in a lost-motion type interconnection to the rod, 12,42,72, a separate solid support 27,57,87 limiting the downward travel of said actuator rod 14,44,74, the second displacement part 15,43,75 being fixedly connected to said upper portion of said actuator rod 14,44,74, one of the displacement parts being a float 13,43,73 and the other of the displacement parts being a displacement weight 15,45,75, the buoyancy of said float 13,43,73 able to float the rod 12,42,72, said actuator rod 14,44,74 and said displacement weight 15,45,75 when said displacement weight 15,45,75 is substantially in fluid but not able to float the rod 12,42,72, said actuator rod 14,44,74 and said displacement weight 15,45,75 when said displacement weight 15,45,75 is substantially out of fluid, switching means 22,78 for the rod 12,42,72 to switch electricity, said switching means 22,78 actuating in the upper position of the rod 12,42,72, retention means 19-20,79-80 to hold the rod 12,42,72 in its upper position and in actuation of said switching means 22,78 as long as the fixedly connected first displacement part 13,45,73 is substantially in fluid but not able to hold the rod 12,42,72 when the first displacement part 13,45,73 is substantially out of fluid, the rising of the fluid substantially above the second displacement part 15,43,75 causing the rod 12,42,72 to rise to its upper position to actuate said switching means 22,78 and said retention means 19-20,79-80 and the falling of the fluid substantially below the first displacement part 13,45,73 causing the rod 12,42,72 to fall to its lower position to deactuate said switching means 22,78 and retention means 19-20,79-80.

9. The switching device of claim 8 characterized in that said switching means and said retention means are both resultant between a magnet means and magnetically attractive material, said magnet means being connected to one of the rod or a switch to switch electricity, said magnetically attractive material being connected to the other of the rod or a switch to switch electricity, the attraction of said magnet and said magnetically attractive material switching the electricity and holding the rod in its upper position.

10. A switching mechanism for a fluid pump comprising a switching rod having upper and lower end portions and being positioned in a substantially vertical position, said switching rod being movable between first and second vertical positions, a compensating part fixedly connected to said lower end portion of said switching rod, said compensating part having a weight when substantially out of the fluid to be pumped, an actuating snubber affixed to said upper end portion of said switching rod, switching means for said switching rod to switch electricity, said switching means actuating in said first vertical position of said switching rod, magnetic means supporting said switching rod in said first vertical position when said compensating part is substantially in the fluid to be pumped but not sufficient to support said switching rod in said first vertical position when said compensating part is substantially out of the fluid to be pumped, an actuator rod having upper and lower end portions and being positioned in a substantially vertical position, support means to slidingly support said actuator rod for movement between first and second vertical positions, a float affixed to said upper end portion of said actuator rod, said float having a positive buoyancy when substantially in the fluid to be pumped and a weight when substantially out of the fluid to be pumped, said positive buoyancy of said float being sufficient to raise said switching rod, said actuator rod and said compensating part when said compensating part is substantially in the fluid to be pumped, said lower end portion of said actuator rod being slidingly connected to said switching rod between said compensating part and said actuating snubber, submerging of said float in the fluid to be pumped causing said float to move said lower end portion of said actuator rod to bear on said actuating snubber and move said switching rod and said compensating part to said first vertical position to actuate said switching means, removal of the fluid from said float moving said lower end portion of said actuator rod away from bearing on said actuating snubber and removal of the fluid from said compensating part creating a weight greater than the supporting attraction of said magnetic means which causes said switching rod to move vertically to said second position to deactuate said switching means.

11. A switching mechanism for a fluid pump comprising a switching rod having upper and lower end portions, said switching rod being movable between first and second vertical positions, a float stopper affixed to said lower end portion of said switching rod, a float slidingly connected to said switching rod above said float stopper, said float having a positive buoyancy when substantially in the fluid to be pumped and a weight when substantially out of the fluid to be pumped, switching means for said switching rod to switch electricity, said switching means actuating in said first vertical position of said switching rod, magnetic means supporting said switching rod in said first vertical position when said float is substantially in the fluid to be pumped but not sufficient for supporting said switching rod when said float is substantially out of the fluid to be pumped, an actuator rod having upper and lower end portions, support means to slidingly support said actuator rod for movement between first and second vertical positions, a compensating part affixed to said upper end portion of said actuator rod, said positive buoyancy of said float being sufficient to float said switching rod, said actuator rod and said compensating part when said compensating part is substantially in the fluid to be pumped but not sufficient to float said switching rod, said actuator rod and said compensating part when said compensating part is substantially out of the fluid to be pumped, said lower end portion of said actuator rod being slidingly connected to said switching rod above said float, actuating means between said switching rod and said actuator rod, the entrance of said float in the fluid to be pumped causing said float to rise and engage said lower end portion of said actuator rod with insufficient force to move said actuator rod to said first vertical position and the entrance of said compensating part in fluid enabling said float to move said actuator rod to bear on said actuating means and to move said switching rod to said first vertical positions to actuate said switching means for said switching rod to switch electricity, removal of the fluid from said compensating part moving said lower end portion of said actuator rod and said float away from said actuating means and removal of the fluid from said float creating a weight greater than the supporting abilities of said magnetic means supporting said switching rod in said first vertical position which causes said switching rod to move vertically to said second position to deactuate said switching means for said switching rod to switch electricity.

12. A switching mechanism for a fluid pump comprising a switching rod having upper and lower end portions and being positioned in a substantially vertical position, said switching rod being movable between first and second vertical positions, a float stopper affixed to said lower end portion of said switching rod, a float slidingly connected to said switching rod above said float stopper, said float having a positive buoyancy when substantially in the fluid to be pumped and a weight when substantially out of the fluid to be pumped, magnetically actuated switching means, magnetic means carried by said upper end portion of said switching rod and in said first vertical position thereof actuating said magnetically actuated switching means, said magnetic means and said magnetically actuated switching means having a magnetic attraction sufficient to support said switching rod in said first vertical position when said float is substantially in the fluid to be pumped but not sufficient to support said switching rod when said float is substantially out of the fluid to be pumped, an actuator rod having upper and lower end portions and being positioned in a substantially vertical position, support means to slidingly support said actuator rod for movement between first and second vertical positions, a compensating part affixed to said upper end portion of said actuator rod, said positive buoyancy of said float being sufficient to float said switching rod, said actuator rod and said compensating part when said compensating part is substantially in the fluid to be pumped but not sufficient to float said switching rod, said actuator rod and said compensating part when said compensating part is substantially out of the fluid to be pumped, said lower end portion of said actuator rod being slidingly connected to said switching rod above said float, actuating means between said switching rod and said actuator rod, the entrance of said float in the fluid to be pumped causing said float to rise and engage said lower end portion of said actuator rod with insufficient force moving said actuator rod to said first vertical position and the entrance of said compensating part in fluid enabling said float to move said actuator rod to bear on said actuating means and to move said switching rod to said first vertical positions to actuate said magnetically actuated switching means, removal of the fluid from said compensating part to move said lower end portion of said actuator rod and said float away from said actuating means and removal of the fluid from said float creating a weight greater than said magnetic attraction which causes said switching rod to move vertically to said second position to deactuate said magnetically actuated switching means.

13. A switching mechanism for a fluid pump comprising a switching rod having upper and lower end portions and being positioned in a substantially vertical position, said switching rod being movable between first and second vertical positions, a compensating part fixedly connected to said lower end portion of said switching rod, said compensating part having a weight when substantially out of the fluid to be pumped, magnetically actuated switching means, magnetic means carried by said upper end portion of said switching rod and in said first vertical position thereof actuating said magnetically actuated switching means, said magnetic means and said magnetically actuated switching means having a magnetic attraction sufficient to support said switching rod in said first vertical position when said compensating part is substantially in the fluid to be pumped but not sufficient to support said switching rod in said first vertical position when said compensating part is substantially out of the fluid to be pumped, an actuator rod having upper and lower end portions and being positioned in a substantially vertical position support, support means to slidingly support said actuator rod for movement between first and second vertical positions, a float affixed to said upper end portion of said actuator rod, said float having a positive buoyancy when substantially in the fluid to be pumped and a weight when substantially out of the fluid to be pumped, said positive buoyancy of said float being sufficient to raise said switching rod, said actuator rod and said compensating part when said compensating part is substantially in the fluid to be pumped, said lower end portion of said actuator being slidingly connected to said switching rod, actuating means between said switching rod and said actuator rod, submerging of said float in the fluid to be pumped causing said float to move said lower end portion of said actuator rod to bear on said actuating means and move said switching rod and said compensating part to said first vertical position to actuate said magnetically actuated switching means, removal of the fluid from said float moving said lower end portion of said actuator rod away from bearing on said actuating means and removal of the fluid from said compensating part creating a weight greater than the supporting attraction of said magnetic means which causes said switching rod to move vertically to said second position to deactuate said magnetically actuated switching means.

14. A switching mechanism for a fluid pump comprising a switching rod having upper and lower end portions and being positioned in a substantially vertical position, said switching rod being movable between first and second vertical positions, a compensating part fixedly connected to said lower end portion of said switching rod, said compensating part having a weight when substantially out of the fluid to be pumped, switching means for said switching rod to switch electricity, said switching means actuating in said first vertical position of said switching rod, magnetic means supporting said switching rod in said first vertical position when said compensating part is substantially in the fluid to be pumped but not sufficient to support said switching rod in said first vertical position when said compensating part is substantially out of the fluid to be pumped, an actuator rod having upper and lower end portions and being positioned in a substantially vertical position support, support means to slidingly support said actuator rod for movement between first and second vertical positions, a float affixed to said upper end portion of said actuator rod, said float having a positive buoyancy when substantially in the fluid to be pumped and a weight when substantially out of the fluid to be pumped, said positive buoyancy of said float being sufficient to raise said switching rod, said actuator rod and said compensating part when said compensating part is substantially in the fluid to be pumped, said lower end portion of said actuator rod being slidingly connected to said switching rod, actuating means between said switching rod and said actuator rod, submerging of said float in the fluid to be pumped causing said float to move said lower end portion of said actuator rod to bear on said actuating means and move said switching rod and said compensating part to said first vertical position to actuate said switching means, removal of the fluid from said float moving said lower end portion of said actuator rod away from bearing on said actuating means and removal of the fluid from said compensating part creating a weight greater than the supporting attraction of said magnetic means which causes said switching rod to move vertically to said second position to deactuate said switching means.

15. A switching mechanism for a fluid device comprising a float, said float movable between first and second positions, a compensating part, said compensating part movable between first and second positions, one of said float or said compensating part being lower than the other of said float or compensating part, connecting means joining said float and said compensating part together in a lost-motion connection whereby said float and said compensating part may move relative to each other, said float having a buoyancy sufficient to float said compensating part and said connecting means when said compensating part is substantially in fluid and insufficient to float said compensating part and said connecting means when said compensating part is substantially out of fluid, switching means actuable between first and second conditions, actuating means carried by said lower of said one of said float or said compensating part, said actuating means movable between first and second positions, said actuating means actuating said switching means to said first condition in said first position of said actuating means, magnetic means acting on said actuating means carried by said lower of said one of said float or said compensating part to hold said actuating means in said first position of said actuating means until sufficient force is exerted thereon to move said actuating means to said second position of said actuating means, said actuating means moving to said first position and actuating said switching means to said first condition in the first position of said upper of said one of said float or compensating part respectively, said actuating means moving to said second position and actuating said switching means to said second condition in the second position of said lower of said one of said float or said compensating part respectively, the entrance of both said float and said compensating part in fluid causing said float, said compensating part and said actuating means to move to said first position and engage said magnetic means with actuation of said switching means and the substantial removal of fluid from said lower of said one of said float and compensating part causing said lower of said one of said float and compensating part and said actuating means to move to said second position and disengage said magnetic means with actuation of said switching means to said second condition.

* * * * *